US005303850A

United States Patent [19]

Connan

[11] Patent Number: 5,303,850

[45] Date of Patent: Apr. 19, 1994

[54] DISPENSING CAP

[75] Inventor: Patrick Connan, Hoeilaart, Belgium

[73] Assignee: Colgate-Palmolive Company, New York, N.Y.

[21] Appl. No.: 918,991

[22] Filed: Jul. 23, 1992

[51] Int. Cl.[5] ..... B67D 5/32; B65D 47/08

[52] U.S. Cl. ..... 222/153; 215/253; 220/266; 222/527; 222/540; 222/562; 222/566

[58] Field of Search ..... 222/23, 153, 527, 534, 222/540, 548, 553, 562, 566; 215/1, 203, 250, 253; 220/266, 268, 270

[56] References Cited

U.S. PATENT DOCUMENTS

| | | | |
|---|---|---|---|
| 507,055 | 10/1893 | Wilson | 222/484 |
| 587,517 | 8/1897 | Bar | 222/553 |
| 648,278 | 4/1900 | Moore | 222/553 |
| 782,104 | 2/1905 | Brunner | 222/484 |
| 868,691 | 10/1907 | Orton | 222/553 |
| 1,273,919 | 7/1918 | Peed | 222/484 |
| 1,476,700 | 12/1923 | Feldstein | 222/553 |
| 1,687,316 | 10/1928 | Rollason | 222/535 |
| 2,249,574 | 7/1941 | Morrison | 222/528 |
| 2,545,350 | 3/1951 | Fuld | 222/484 |
| 2,966,286 | 12/1960 | Moran | 222/553 |
| 3,118,578 | 1/1964 | Collins | 222/548 |
| 3,154,226 | 10/1961 | Petitto | 222/528 |
| 3,248,025 | 4/1966 | Santore | 222/484 |
| 3,278,095 | 10/1966 | Johns | 222/507 |
| 3,317,093 | 5/1967 | Moran | 222/548 |
| 3,342,385 | 9/1967 | Knight | 222/485 |
| 3,357,605 | 12/1967 | Chadfield | 222/485 |
| 3,782,610 | 1/1974 | Gilbert | 222/484 |
| 4,207,996 | 6/1980 | Moen | 222/507 |
| 4,241,855 | 12/1980 | Yoshioka | 222/553 X |
| 4,376,497 | 3/1983 | Mumford | 222/153 |
| 4,444,328 | 4/1984 | Glass | 215/230 |
| 4,595,123 | 6/1986 | Libit | 222/23 |
| 4,941,592 | 7/1990 | Kitterman | 222/23 |
| 4,961,515 | 10/1990 | Schreiber | 222/48 |

FOREIGN PATENT DOCUMENTS

| | | | |
|---|---|---|---|
| 1297534 | 8/1962 | Fed. Rep. of Germany . | |
| 613958 | 12/1960 | Italy | 222/553 |
| 357670 | 11/1961 | Switzerland . | |
| 628276 | 8/1949 | United Kingdom . | |
| 2041739 | 9/1980 | United Kingdom . | |

*Primary Examiner*—Sherman Basinger

*Attorney, Agent, or Firm*—Michael J. McGreal; Robert C. Sullivan

[57] ABSTRACT

A tamper indicating closure includes a one-piece cap having a dispensing outlet which is aligned with a dispensing outlet in the neck of a bottle upon rotation of the cap. A removable tamper resistant detent extends downwardly from the top end of the cap and nests with a recess in the upper edge of the neck of the bottle to prevent rotation of the cap. The removable tamper resistant detent is torn free of the cap such that the cap can be rotated to an open position. The closure may also contain a flexible spout which can be folded outwardly by rotation of the cap to an open position.

22 Claims, 5 Drawing Sheets

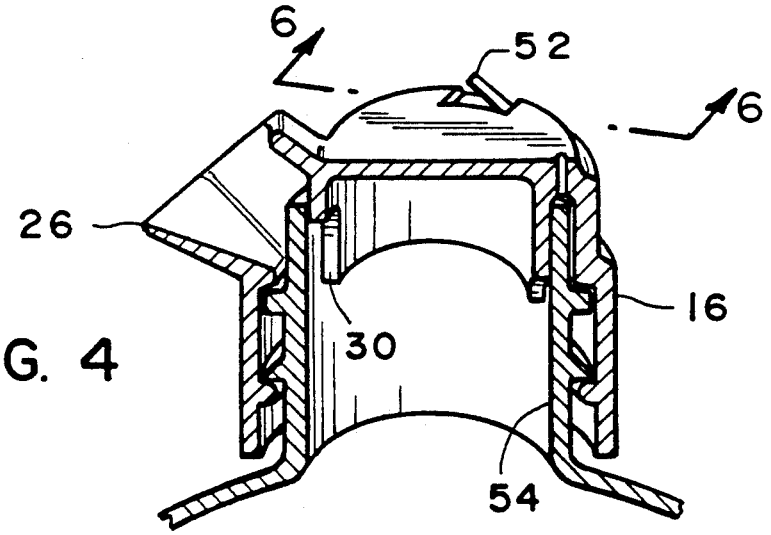
FIG. 4
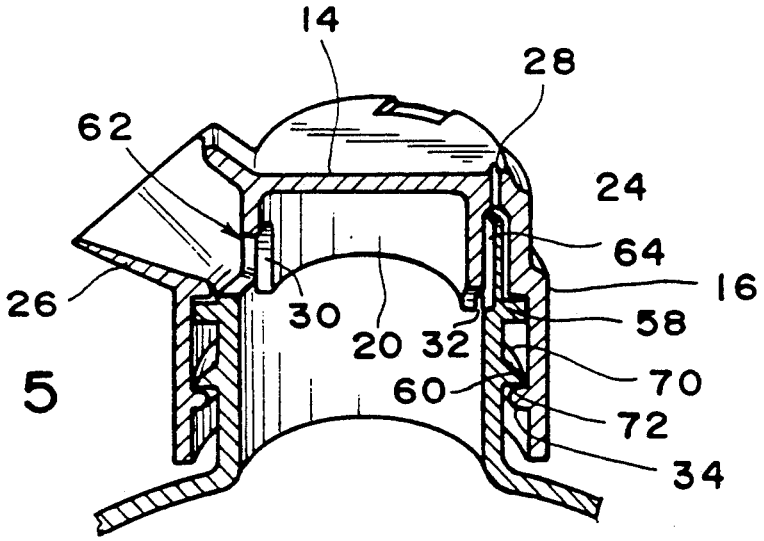
FIG. 5
FIG. 6A
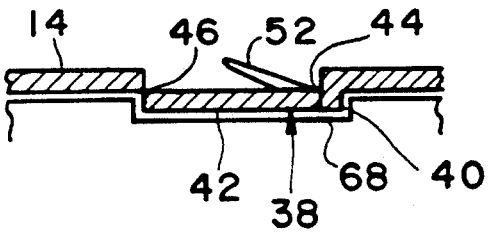
FIG. 6B
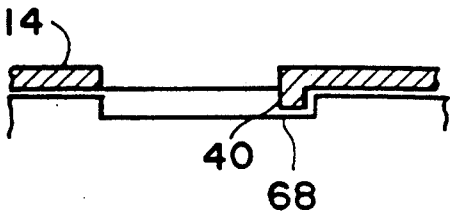

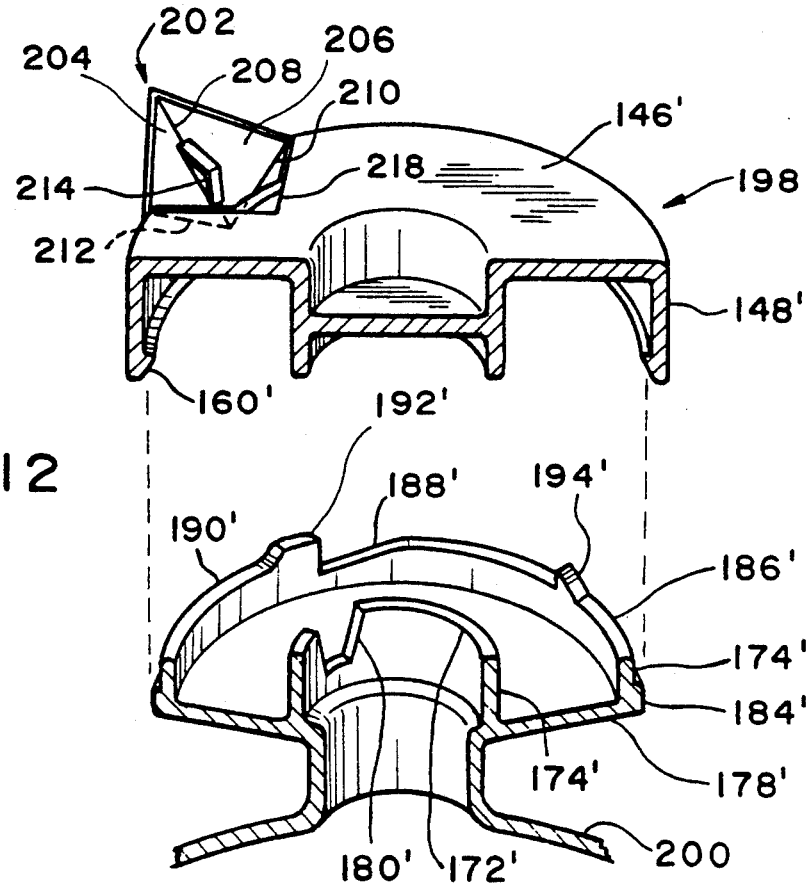
FIG. 12
FIG. 13
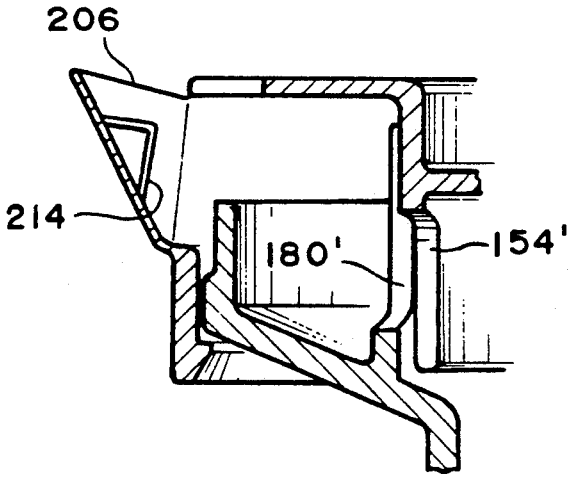
FIG. 14
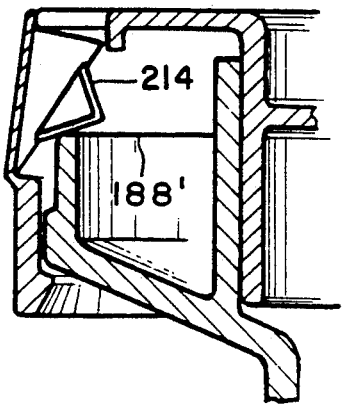

DISPENSING CAP

FIELD OF THE INVENTION

The present invention relates to bottle closures having a tamper-resistant indicator. More particularly, the invention is directed to a one-piece dispensing closure having a flexible pouring spout and a tamper-resistant tear strip.

BACKGROUND OF THE INVENTION

Dispensing closures have been available for a number of years for dispensing liquids and granular materials from containers. A common feature of these closures is the inclusion of a re-closable dispensing outlet. These closures typically include a hinged top, a top which is opened by pulling upward on the top or dispensing apertures which are aligned by a twisting motion to open the container. A common problem to many of these fluid dispensing closures is a weakness in the sealing arrangement which often result in leakage during shipping. In addition, these closures often are two-piece assemblies resulting in a closure having a number of movable components. These two-piece closures typically result in increased manufacturing and assembling costs.

The rotatable type caps are sometimes designed to serve as valves for dispensing the contents of the containers and are therefore permanently assembled onto the containers. These caps usually provide for the alignment of dispensing apertures in the container and the closure by rotational movement of the closure. These caps must be operable to provide definite and distinct open and closed positions in order to produce free flow of the container contents and to avoid leakage in the closed position. The closures should also be capable of easy insertion upon the containers and provide permanent connection to resist removal or dislodging of the closure.

Rotatable dispensing closures are also known which include an air vent to allow the contents of the container to be easily dispensed. One example of a rotatable closure having an air vent is U.S. Pat. No. 3,118,578 to Collins. The closure includes an outer wall and an inner wall to define an annular space to receive the neck of the bottle. A dispensing outlet extends through the top portion of the cap to the inner wall. The inner surface of the neck of the bottle includes a channel which can be aligned with the dispensing channel in the cap by rotation of the cap with respect to the bottle.

A further example of a rotatable closure having a dispensing channel which aligns with a dispensing outlet in the neck of the bottle is disclosed in U.S. Pat. No. 4,961,515. The closure includes a top portion and inner and outer walls depending from the top. An annular space between the inner and outer walls receives the neck portion of the bottle. The upper edge of the neck of the bottle includes a U-shaped opening which aligns with dispensing apertures in the inner and outer walls of the cap upon rotation of the cap with respect to the bottle. Other examples of similar dispensing containers including a cap having a dispensing outlet which can be aligned with a dispensing outlet in the neck of a bottle by rotating the cap with respect to the bottle are disclosed in U.K. Pat. application 2041739A, U.S. Pat. No. 4,444,328, U.S. Pat. No. 3,357,605, U.S. Pat. No. 3,342,385, U.S. Pat. No. 3,248,025, U.S. Pat. No. 1,476,700, U.S. Pat. No. 1,273,919, U.S. Pat. No. 868,691, U.S. Pat. No. 782,104 and U.S. Pat. No. 507,055.

Other examples of rotatable dispensing closures having Gilbert, U.S. Pat. No. 2,545,350 to Fuld and U.S. Pat. No. 3,317,093 to Moran.

Numerous closures have also been produced which include a collapsible pouring spout which can be opened to dispense the contents of the container. These devices typically include a number of moving parts and are subject to leaking. Other closures which include a pouring spout have a flexible dispensing outlet connected to the bottle. A rotatable cap is mounted on the bottle such that the dispensing outlet extends through an aperture in the wall of the cap. Rotation of the cap typically causes the flexible dispensing outlet to fold over thereby pinching the outlet in the closed position. Examples of this type of flexible spout and closure are disclosed in U.S. Pat. No. 3,278,095 to Johns and U.S. Pat. No. 4,207,996 to Moen.

For many food and drug items, it is necessary to provide packaging which is tamper-resistant so that the consumer can immediately discern whether the item is in the original unopened package. It is usually preferred to provide a tamper-resistant arrangement whereby a purchaser can visually determine the unopened condition of the package.

Tamper-resistant closures are known which include a rotatable cap which can be rotated from a closed to an opened position. It is particularly desirable in this type of closure to enable the package to be re-closed without defeating the tamper-resistant feature.

The above-noted closures have the disadvantage of being unduly complicated to manufacture, assemble and use and require numerous parts. Furthermore, these devices do not ensure an effective seal to prevent leakage of the contents of the container.

SUMMARY OF THE INVENTION

The present invention is directed to a closure having a tamper resistant or tamper indicating feature. More particularly, the invention is directed to a closure comprising a one-piece cap having a dispensing outlet which is aligned with a dispensing outlet on the neck of a bottle upon rotation of the cap. The tamper-resistant feature prevents unauthorized rotation of the closure with respect to the bottle and provides a tamper indicating feature to indicate the closure has been opened.

The closure of the invention is preferably produced from a plastic material which is relatively easy and inexpensive to manufacture and is easily assembled onto a bottle. The closure further provides positive opening and closing of the container and provides an effective seal to prevent leakage during shipping.

In a first embodiment of the invention, the closure includes a top end, an outer annular wall depending from the outer edge of the top end and extending toward an open bottom end, and an inner annular wall depending from the top end and extending toward the bottom end and concentric to the outer wall to define an annular space. A pouring spout extends from the closure and communicates with the annular space. A dispensing outlet aperture extends through the inner wall proximate to the spout.

The closure fits onto a generally cylindrical bottle neck attached to a bottle. The neck has an outer diameter complementing the inner diameter of the inner wall such that the inner wall of the closure fits tightly in the neck of the bottle. A dispensing outlet extends transversely through the neck of the bottle so as to be aligned with the dispensing outlet of the inner wall of the closure upon rotation of the closure relative to the bottle. The annular top edge of the neck of the bottle has a recessed step portion extending along an arcuate length of the top edge. The closure includes a tamper resistant detent depending from the top end of the closure in the annular space between the inner and outer walls and extends toward the bottom end of the closure. The detent includes a first portion fixed to the top end and a second portion removably attached to the closure.

The closure is assembled onto the neck of the bottle such that the neck fits within the annular space of the closure and the detent is received in the step portion of the top end of the bottle. The detent has a length approximating the length of the recessed stepped portion of the bottle to prevent rotation of the closure with respect to the bottle until the second portion of the detent is removed from the closure. In a preferred embodiment, the second portion of the detent is attached to the closure by a weakened or frangible line. A pull tab is attached to the second portion of the detent such that the second portion of the detent can be torn free of the closure. Once the second portion of the detent is removed, the closure is allowed limited rotational movement with respect to the bottle with the first portion of the detent being received in the stepped portion of the neck of the bottle.

In a further embodiment, the closure includes a flexible spout which can be folded outward to a dispensing position. The spout includes a pair of triangular-shaped panels connected together by a first hinge. Each of the triangular panels are also hinged to the closure and positioned such that the spout extends from the closure when in the opened position. The closure also includes a top end, an outer annular exterior wall depending from the top end, and an inner annular wall depending from the top end and extending toward the open bottom end and concentric with the outer wall. The inner wall includes a dispensing outlet proximate to the flexible spout.

The closure is coupled to a generally cylindrical bottle neck attached to a bottle such that the neck extends into the annular space of the closure between the inner and outer walls. The neck of the bottle includes a dispensing outlet which can be aligned with the dispensing outlet of the inner wall upon rotational movement of the closure with respect to the bottle. The upper edge of the neck of the bottle includes a notched recess spaced radially from the dispensing outlet in the neck. The closure is assembled on the neck of the bottle with the neck received in the annular space between the inner and outer walls of the closure. The closure is assembled in the closed position such that the spout is aligned with the notched recess. The flexible spout is bent downward into the recess. Rotation of the closure with respect to the bottle causes the notched recess to cam the flexible closure upwardly to the open position such that the spout is directed upwardly as the closure is rotated to align the dispensing outlets.

BRIEF DESCRIPTION OF THE DRAWINGS

The invention is illustrated in the appended drawings of which the following is a brief description.

FIG. 4 is a perspective view of the closure showing the upper surface of the detent and the removable portion of the detent.

FIG. 5 is a cross-sectional view of the closure assembled on the neck of the bottle in the open position.

FIG. 6A is a partial cross-sectional view of the closure taken along lines 6—6 of FIG. 4 showing the tamper resistant feature in the closed position and FIG. 6B is a cross-sectional view after the removable tamper resistant feature is removed.

FIG. 12 is an exploded view of a further embodiment of the invention showing a flexible spout coupled to the outer annular wall of the closure.

FIG. 13 is a partial cross-sectional view of the embodiment shown in FIG. 12 showing the spout in the open position.

FIG. 14 is a cross-sectional view of the embodiment of FIG. 12 showing the flexible spout in the closed position.

DETAILED DESCRIPTION OF THE INVENTION

Figure 1:
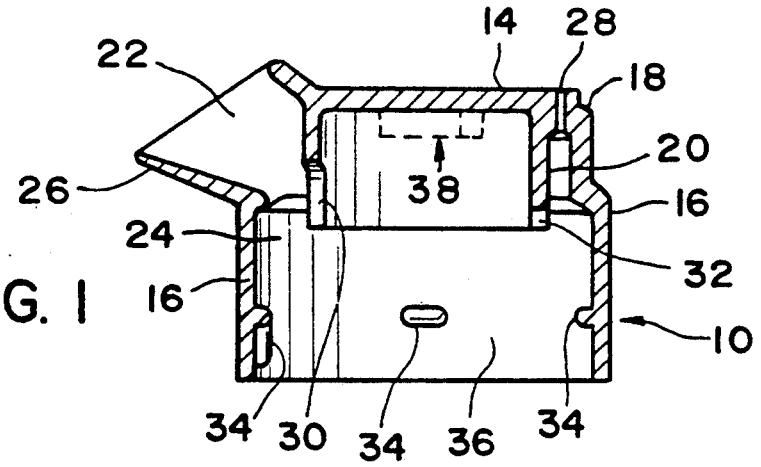
FIG. 1 is a cross-sectional view of a first embodiment of the invention showing the top end, inner annular wall, and the outer annular wall.

Referring to FIGS. 1–14, the closure 10, in accordance with the invention, is intended to be connected to a bottle 12 for rotational movement with respect to the bottle from a closed position to an opened position.

In a first embodiment of the invention illustrated in FIGS. 1–6B, the closure 10 is a rotatable cap which includes a top end 14 having a depending annular outer wall 16 extending from a peripheral edge 18 of the top end 14 toward an open end of the cap. An inner wall 20 depends from the top end 14 and extends toward the open end of the closure concentric with the outer wall 16. The inner wall 20 may be the same length as or different from the length of the outer wall 16. As discussed hereinafter in greater detail, the inner wall fits in the neck of a bottle such that the length of the inner wall enables the cap to form a tight seal.

The inner wall 20 defines an annular space between the inner wall and the outer wall 16 to receive the neck of the bottle 12. A dispensing outlet 22 extends through the outer wall 20 from the annular space 24. A spout 26, as shown in FIG. 1, extends outwardly from the outer wall 16. An air inlet 28 extends through the top end 14 of the closure to the annular space 24 at a point opposite the dispensing outlet 22.

The inner annular wall 20 includes a dispensing outlet 30 extending through the annular wall proximate the dispensing outlet 22 of the annular space 24. In the embodiment illustrated in FIG. 1, the dispensing outlet 30 is a U-shaped notch opening downwardly toward the open end of the closure. Alternatively, the dispensing outlet 30 may be an aperture in the annular wall 20. An air inlet 32 extends through the annular inner wall 20 to connect the annular space 24 with the space within the inner annular wall 20 and the air vent 28. The air inlet 32 is preferably positioned opposite the dispensing outlet 30 and adjacent the air vent 28. As shown in FIG. 1, the air inlet 32 is a downwardly open notch in the lower annular edge of the inner wall 20. In alternative embodiments, the air inlet 32 may be an aperture extending through the inner annular wall 20 to communicate with the annular space 24.

Figure 2:
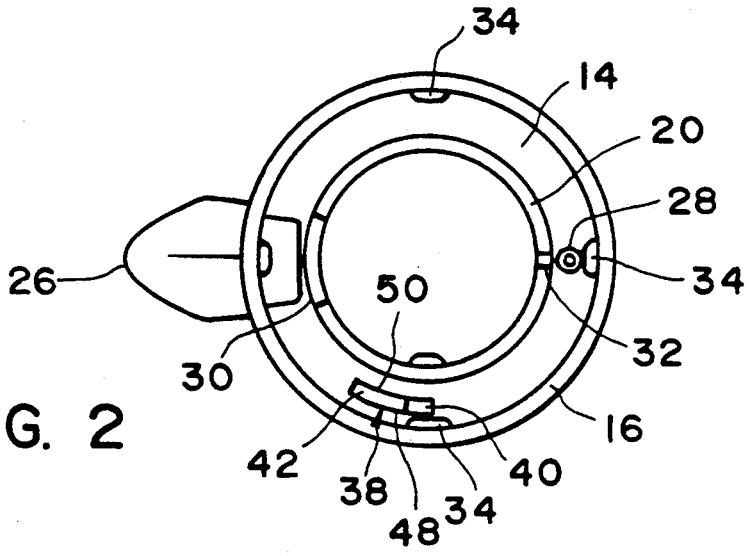
FIG. 2 is a bottom view of the closure as seen from the bottom end of FIG. 1.

The outer annular wall 16 is dimensioned to fit over the neck of a bottle 12. A plurality of retaining detents 34 depend from the inner surface 36 of the outer annular wall 16 and extend radially inward toward the center of the closure. As shown in FIG. 2, the retaining detents 34 are spaced uniformly around the inner surface 36 of the outer wall 16. Alternatively, the retaining detents 34 are in the form of a depending skirt or collar.

A tamper resistant detent 38 depends from the top end 14 of the closure and extends toward the open bottom end of the closure as shown in phantom lines in FIG. 1 and in the bottom view of FIG. 2. As best shown in the perspective view of FIG. 2 and the cross-sectional view of FIG. 6A, the detent 38 comprises a first leg 40 fixed to the top end 14 and extending into the annular space 24. A tamper resistant second leg 42 contiguous with the first leg 40 also depends from the top end 14 of the closure into the annular space 24. As best shown in FIG. 6A, the second leg 42 of the detent is attached to the top end 14 by frangible tear lines 44, 46 at each end of leg 42 and by frangible tear lines along side edges 48, 50 of the leg 42, as shown in FIG. 2. The frangible tear lines may be perforations although preferably are thin portions molded in the closure to allow the removable leg 42 to be pulled free from the closure. A pull tab 52 is attached to the second leg 42 of the detent extending from the top end 14 of the closure to assist in the removal of the second leg 42.

The closure 10 in preferred embodiments of the invention is a one-piece molded unit formed from an elastomeric plastic material, such as polyethylene, polypropylene and copolymers thereof which will provide the flexibility required for assembly and operation.

Figure 3:
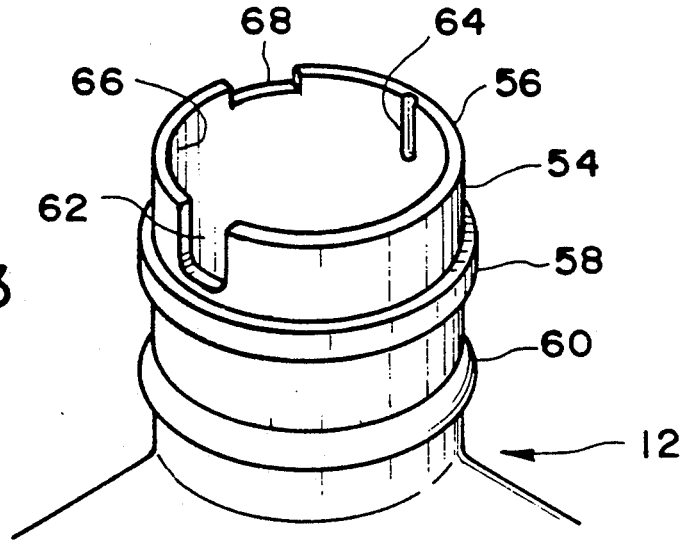
FIG. 3 is a perspective view of the bottle neck showing the dispensing aperture, the notch to limit rotational movement of the closure with respect to the bottle, and the air vent.

The bottle 12 as shown in FIG. 3 comprises a generally cylindrical neck 54 having an annular upper edge 56. A sealing collar 58 depends from the neck 54 and extends radially outward. At a lower edge of the neck 54 is a retaining flange 60 extending radially outward from the neck. A dispensing outlet 62 extends through the neck 54 at or near the top end of the neck to the interior of the bottle. In the embodiment shown in FIG. 3, the dispensing outlet 62 is a substantially U-shaped notch. Alternatively, the dispensing outlet may be an aperture extending through the neck 54. An air intake vent 64, in the form of an axial groove on the inner wall 66 of the neck, is positioned opposite the dispensing outlet 62. A recessed step portion 68 is included in the upper edge 56 of the neck 54 to complement the detent 38 depending from the top end 14 of the closure.

FIGS. 1-3 illustrate the closure 10 and the bottle 12 prior to assembly. FIG. 4 shows the closure assembled on the bottle in the closed and tamper resistant position while FIG. 5 illustrates the closure 10 and the bottle 12 in the opened position after the tamper resistant leg has been removed.

To assemble the closure, the closure 10 is placed over the neck 54 of the bottle such that the neck 54 is received in the annular space 24 between the inner and outer annular walls 16, 20 of the closure. The closure 10 is forced downwardly toward the bottle until the upper annular edge 56 of the neck contacts the top end 14 of the closure and the retaining detents 34 on the closure 10 slide over the retaining flange 60 on the neck. Preferably, the inner annular wall 20 fits tightly against the inner surface of the neck to provide a fluid tight seal. As best shown in FIG. 5, the retaining flange 60 includes a tapered upper surface 70 to allow the detents 34 to slide over the retaining flange during assembly. The lower edge 72 of the retaining flange 60 is angled to resist upward movement of the closure with respect to the bottle to prevent accidental disassembly. The sealing collar 58 extends outwardly from the neck of the bottle a distance complementing the inner diameter of the outer annular wall 16 of the closure to provide sealing engagement with the closure while allowing rotational movement of the closure with respect to the bottle.

As shown in FIG. 6A, the detent 38 is dimensioned to fit neatly within the recess 68 in the upper edge of the neck 54 to prevent rotational movement of the closure with respect to the bottle in the assembled position. In operation, the pull tab 52 is pulled by the operator to remove the tamper resistant second leg 42 of the detent by pulling upwardly from the closure 10. The frangible tear lines 44, 46, 48 and 50 allow the second leg 42 to be easily removed from the closure. The first leg 40 of the detent is dimensioned such that when the second leg 42 is removed from the closure, the first leg 40 allows limited rotational movement of the closure with respect to the bottle by the first leg 42 sliding in the recess 68. The end walls of the recess 68 serve as a stop to limit the rotation of the closure as shown in FIG. 6B. The first leg 40 of the detent and the recess 68 complement each other to allow rotation of the closure from an open to a closed position after the second leg 42 is removed. In the embodiment shown in FIGS. 1-6B, the closure is opened by rotating the closure in a counter-clockwise direction.

As shown in FIG. 5, the closure 10 is mounted on the bottle 12 for rotational movement with respect to the bottle from an open position to a closed position. By rotating the closure 10 on the bottle, the dispensing outlet 30 in the inner annular wall 20 of the closure aligns with the dispensing outlet 62 in the neck 54 of the bottle. Simultaneously, the air inlet 28 in the top end 14 of the closure and the air inlet 32 in the inner annular wall 20 align with the air inlet 64 in the inner surface of the neck. In this fashion, the contents of the container can be dispensed by pouring the contents through the dispensing outlets 30 and 62 with air entering the bottle through the vent 28. Preferably, the air vent 28 is dimensioned proportionally with the dispensing outlets 30 and 62 to prevent the contents of the container from exiting the bottle through the air vent 28.

Figure 7:
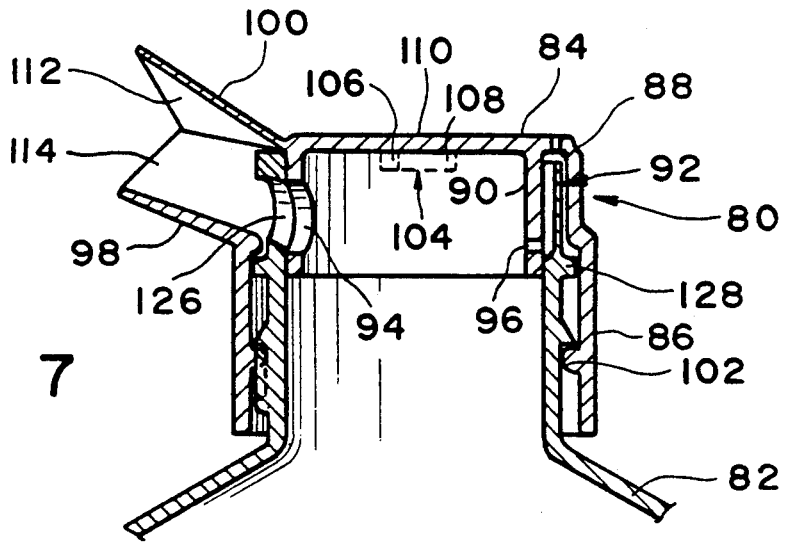
FIG. 7 is a cross-sectional view of a second embodiment of the invention showing the top end of the closure, an inner annular wall, an outer annular wall and the flexible spout in the open position.
Figure 8:
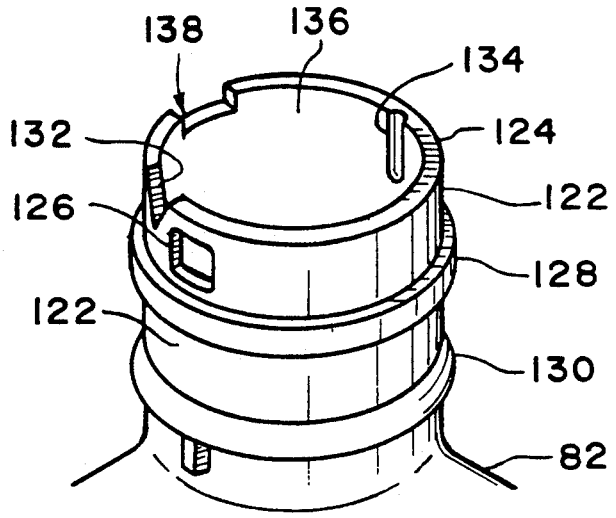
FIG. 8 is a perspective view of the neck of the bottle showing the dispensing outlet, recessed notch to receive the flexible spout in the closed position, and a detent receiving notch to limit rotational movement of the closure on the bottle neck.
Figure 9:
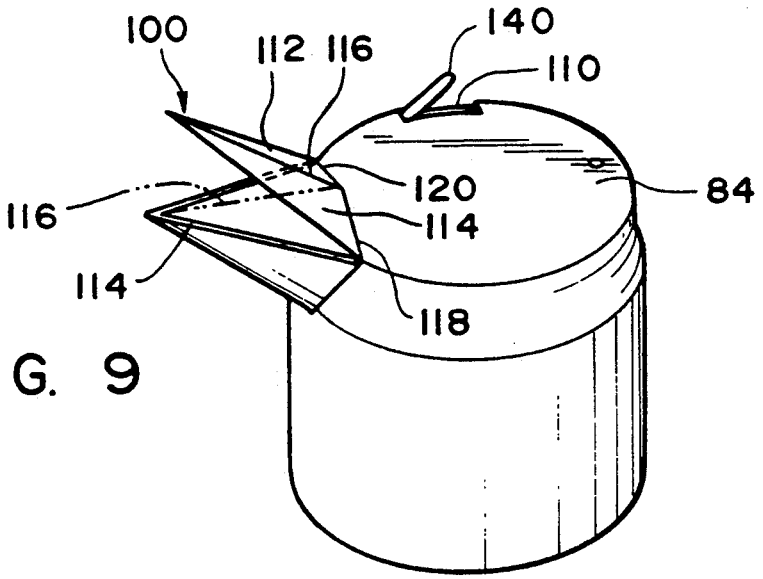
FIG. 9 is a perspective view of the embodiment of the invention as shown in FIG. 7 illustrating the tamper-resistant feature.

In a further embodiment of the invention shown in FIGS. 7, 8 and 9, a closure 80 comprises a cap assembled on a bottle 82 for rotational movement with respect to the bottle. FIG. 7 illustrates a cross-sectional view of the closure and bottle in the assembled and open position. The closure 80 includes a top end 84 and an outer annular wall 86 extending from the peripheral edge 88 of the top end 84 toward an open end of the closure. An inner annular wall 90 depends from the top end 84 and extends coaxially with the outer annular wall 86 toward the open end of the closure. The inner wall 90 defines an annular space 92 between the inner and outer walls.

The inner annular wall 90 includes a dispensing outlet 94 passing through the wall 90. As illustrated, the dispensing outlet is an aperture although a downwardly open U-shaped slot may also be used. An air inlet 96 extends through the inner wall 90 and is positioned opposite the dispensing outlet 94 as best shown in FIG. 7.

The outer annular wall 86 includes a pouring spout 98 extending outwardly from the closure 80. The pouring spout 98 is preferably positioned adjacent the dispensing outlet 94 in the inner annular wall 90. A flexible spout 100 is attached to the top end 84 of the closure and is positioned to close the spout 98 by folding downwardly as discussed hereinafter in greater detail. A plurality of detents 102 project inwardly from the outer annular wall 86 at the open end of the closure to retain the closure on the bottle.

A tamper resistant detent 104 depends from the top end 84 extending into the annular space 92 between the inner annular wall 90 and the outer annular wall 86 when the cap is in the closed position. The detent 104, as shown in phantom lines in FIG. 7, comprises a fixed leg 106 permanently attached to the top end 84 of the closure and a second removable leg 108 attached to the top end 84 by frangible tear lines 110. The fixed leg 106 of the detent and the removable tamper resistant leg 108 is substantially the same as in the embodiment of FIGS. 1-6B. It can be readily seen that in the closed position the detent 104 is received in a recess 138 in the neck of the bottle 82.

As best shown in FIG. 9, the flexible spout 100 comprises two triangular-shaped panels 112 and 114. The panels 112 and 114 are connected together along contiguous edges by a flexible hinge 116. The edge of each panel adjacent the hinge 116 joining at a common apex are connected to the top end 84 by flexible hinges 118 and 120. In preferred embodiments of the invention, hinges 116, 118 and 120 are formed from weakened lines commonly referred to as living hinges. .As shown, the panels 112 and 114 are dimensioned to extend upwardly from the top end 84 as shown in FIGS. 7 and 9 when in the open position. The closure is preferably formed from a flexible plastic material such that the flexible spout can be folded downwardly along hinges 118, 120. The panels are preferably dimensioned to extend upwardly from the top end in the open position and to be able to be folded downwardly in a snap, over-center type action.

The bottle 82 comprises a neck 122 having an upper annular edge 124. A dispensing outlet 126 extends through the neck 122. A sealing collar 128 depends from the neck 122 and extends radially outward. A retaining flange 130 also extends from the neck 122. An air inlet 96 in the form of an axial groove is included in the inner surface 128 of the neck 122 adjacent the upper annular edge 124. A stepped recess 130 in the upper annular edge 124 is included to receive the detent 104 when the closure is assembled onto the neck of the bottle. A V-shaped recess 132 is also included in the upper annular edge 124. As shown in FIG. 8, the V-shaped recess 132 is radially spaced from the dispensing outlet 126.

The device of the invention is assembled by placing the closure 80 onto the neck of the bottle 82 such that the neck 122 is received in the annular space 92 between the inner annular wall 90 and the outer annular wall 86. The closure is pressed downwardly so that the retaining detents 102 on the inner surface of the outer annular wall 86 slide past the retaining collar 130. As best shown in FIG. 7, the closure 80 is rotatable with respect to the bottle 82 to align the dispensing outlet 94 in the inner wall 90 of the closure with the dispensing outlet 126 in the neck 122 of the bottle 82. The detent 104 depending from the top end 84 is received in the recess 138 in the upper annular edge of the bottle to resist rotation of the closure until the tamper resistant second leg 108 of the detent is removed by tearing along the frangible line 110 by pulling firmly on pull tab 140. When the tamper resistant second leg 108 is removed, the first leg 106 is able to slide in the recess 138 thereby allowing limited rotational movement of the closure from a closed to an open position. The vertical side walls of the recess 138 serve as stops when the fixed detent 106 engages the walls to limit rotation of the closure.

When the closure 80 is assembled on the neck 122 of the bottle 82, the detent 104 is received in the recess 138. The flexible spout 100 is folded inwardly in a closed position and is received in the V-shaped recess 132. In operation, the pull tab 140 is pulled to separate the second leg 108 from the top end 84 of the closure. The closure is then able to be rotated with respect to the bottle with the first leg 106 of the detent sliding in the recess 138. During rotation of the closure, the V-shaped recess 132 acts as a cam surface to urge the flexible spout 100 upwardly to the open position as shown in FIG. 7. The removal of the pull tab 140 and the removable leg 108 provide a positive indication that the closure has been tampered and the bottle has been opened.

Figure 10:
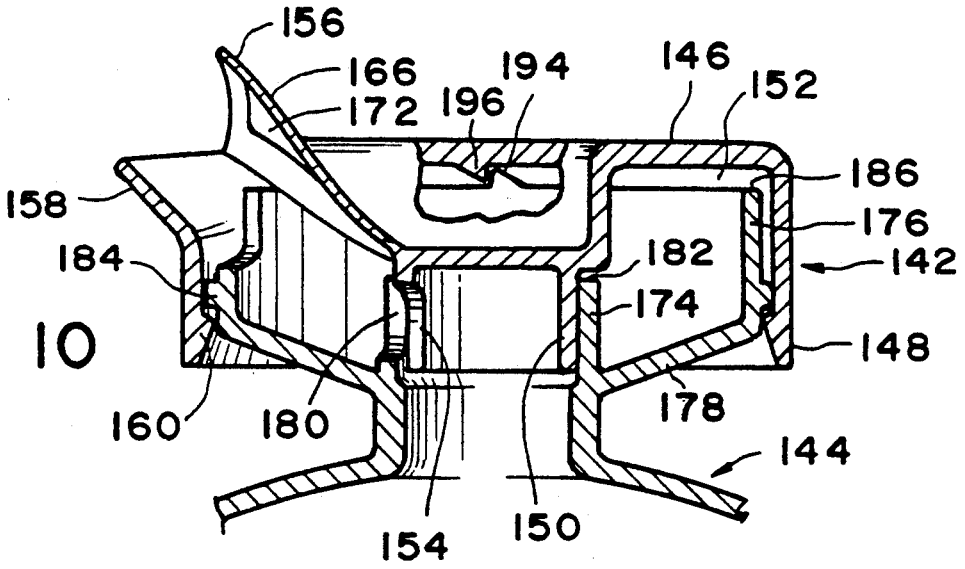
FIG. 10 is a cross-sectional view of a further embodiment of the invention showing the flexible spout in the open position and dispensing outlets in the neck of the wall and the inner wall of the closure aligned in the open position.
Figure 11:
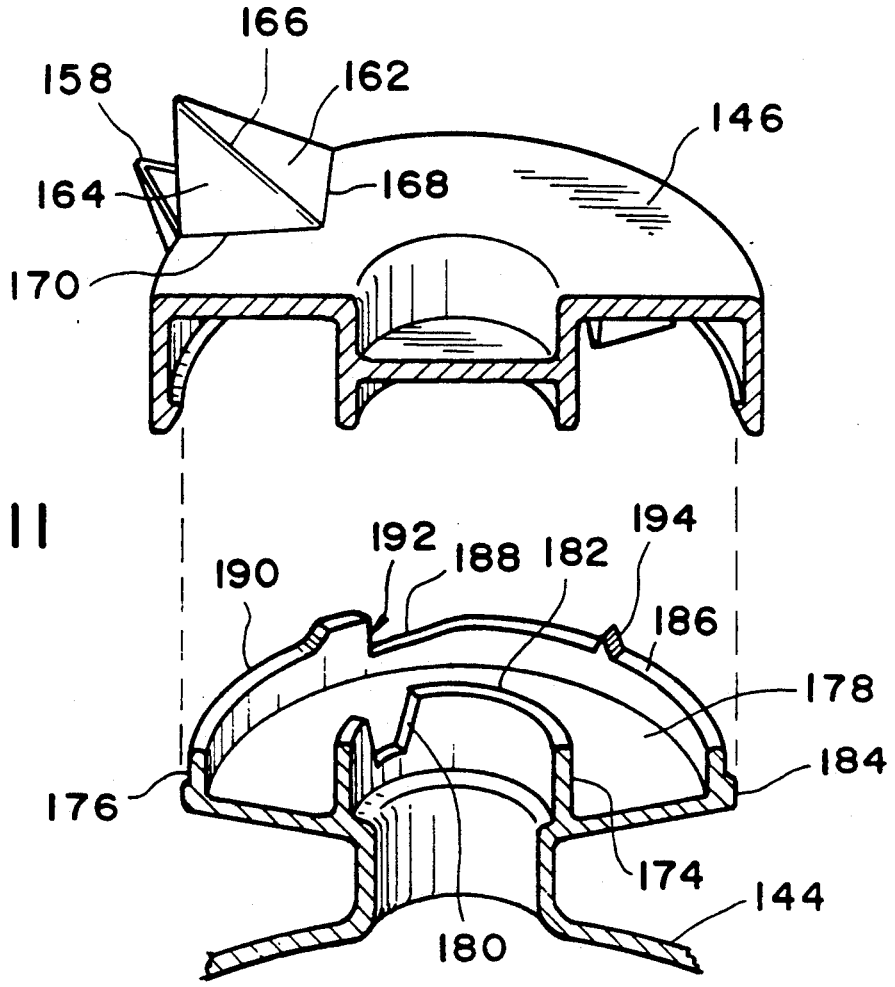
FIG. 11 is an exploded view of the embodiment of FIG. 10.

Referring to FIGS. 10 and 11, a further embodiment of the invention is illustrated comprising a closure 142 and a bottle 144. The closure 142 comprises a top end 146 having an outer annular wall 148 depending from the peripheral edge of the top end and extending toward an open end of the closure. An inner annular wall 150 depends from the top end 146 and extends toward the open end of the closure concentric with the outer annular wall 148. An annular space 152 is defined between the inner annular wall 150 and the outer annular wall 148. A dispensing outlet 154 extends through the inner annular wall 150. A flexible spout 156 is formed in the top end 146 adjacent the dispensing outlet 154 in the inner wall 150. A pouring spout 158 extends outwardly from the outer annular wall 148 and is positioned adjacent the flexible spout 156 and the dispensing outlet 154. A retaining flange 160 depends from the outer annular wall 148 and extends radially inward toward the inner annular wall 150.

The flexible spout 156 comprises a pair of triangular panels 162, 164 hinged together along the flexible joint 166. The panels 162, 164 are hinged to the top end 146 along flexible joints 168 and 170. In an alternative embodiment, the flexible spout does not include a well defined joint 166. Furthermore, the flexible joints 168, 170 may form a continuous curve instead of straight lines as shown in FIG. 10. In a preferred embodiment, the flexible spout 156 is formed on the closure in the open position, as shown in FIG. 10, and is sufficiently flexible to be flipped downward to a closed position in a snap, over-center type action. A cam follower 172 is preferably formed on the underside of one of the panels 164, 166 as shown in FIG. 10. As shown, the cam follower 172 is a triangular shaped wedge although any other suitable shape may be used.

The bottle 144 comprises a neck portion having an inner annular wall 174 extending upwardly from the bottle. An outer annular wall 176 depends from the neck of the bottle and extends upwardly from the bottle and coaxial with the inner annular wall 174. An annular space is defined between the inner annular wall 174 and the outer annular wall 176 by a connecting skirt portion 178.

A dispensing outlet 180 extends through the inner annular wall 174 and is positioned to align with the dispensing outlet 154 in the inner annular wall 150 of the closure upon rotation of the closure with respect to the bottle. In the embodiment illustrated in FIG. 10, the dispensing outlet 180 is a substantially U-shaped recess in the upper annular edge 182 of the inner wall 174. Alternatively, the dispensing outlet 154 in the closure may be an aperture extending through the inner wall 150 of the closure.

A sealing collar 184 depends from the outer annular wall 176 and extends radially outward for engagement with an inner surface of the outer annular wall 148 of the closure. As best shown in FIG. 11, the outer annular wall 176 of the bottle includes an upper annular surface 186. The upper annular surface 186 includes a first recessed portion 188 angularly spaced from the dispensing outlet 180 and a second recessed portion 190 positioned adjacent the dispensing outlet 180. The recessed portion 188 includes a vertical sidewall 192 perpendicular to the upper edge 186.

As shown in the fragmented view of FIG. 11, a wedge-shaped detent 194 depends from the edge portion 186 and extends upwardly toward the closure. A second wedge-shaped detent 196 extends downwardly from the inner surface of the top end 146 of the closure. As can be seen in FIG. 10, the detents 194 and 196 serve as a ratchet to allow limited rotation of the closure in one direction only.

The closure 142 is assembled onto the neck of the bottle by sliding the closure onto the bottle until the retaining flange 160 of the closure slides past the retaining collar 184 on the outer wall 176 of the neck. The closure is assembled in the fully closed position such that the flexible spout 156 is aligned with the recess 188 in the outer annular wall 184 of the bottle. The flexible spout is pressed down to flip inwardly against the bottom of the recess 188. Preferably, the detents 194 and 196 are positioned with the inclined surfaces facing each other.

In operation, the closure 142 is rotated with respect to the bottle such that the inclined surfaces of the ratchet detents 194 and 196 slide over each other as shown in FIG. 10. As the closure 142 is rotated, the cam follower 172 engages the perpendicular wall 192 of the recess 188 causing the flexible spout 156 to flip upwardly into the open position as shown in FIG. 11. Further rotation of the closure 142 aligns the dispensing outlet 180 in the inner annular wall 174 of the bottle with the dispensing outlet 154 in the inner annular wall 150 of the closure. The detents 194 and 196 are preferably positioned to allow the closure 142 to be rotated sufficiently in a closing direction to cause the dispensing outlets 154 and 180 to no longer be aligned and close the outlet to the bottle without allowing the closure to be rotated back to the starting position. By preventing the closure from being rotated back to the starting position, the flexible spout 156 cannot be aligned with the recess 188 and thus cannot be pushed downwardly into the closed position thereby providing a permanent tamper indicating feature. A suitable stop may also be included in the neck of the bottle to prevent the closure from being rotated in the opening direction past the open position.

Illustrated in FIGS. 12–14 is a modified embodiment of the invention with a flexible spout extending outwardly from the outer annular wall of the closure. In the embodiment of FIGS. 12–14, the structure of the closure 198 and the bottle 200 is substantially the same as that disclosed in FIGS. 10 and 11, with the exception of the position of the flexible spout. Thus, like reference numerals with a prime are used for the similar structure set forth in FIGS. 10 and 11.

The closure 198, in accordance with the invention, includes a flexible spout 202 depending from the outer annular wall 148'. A substantially V-shaped notch 218 is provided in the top end 146' to receive the flexible spout in the closed position. The spout 202 comprises first and second flexible triangular-shaped panels 204 and 206 connected together along a hinge 208. The panels 204 and 206 are connected to the outer wall 148' of the closure by a flexible hinge portion 210 and 212, respectively. A cam follower 214 is attached to an inner face of the panel 204. The remaining portions of the closure are substantially the same as the embodiment illustrated in FIG. 10. The bottle 200 is also substantially the same as the bottle illustrated in FIG. 10.

In operation, the closure 198 is placed over the neck of the bottle 200 in the fully closed position such that the flexible spout 202 is aligned with the recess 188'. The flexible spout 202 is then pressed inwardly and is received within the recess 188' and the V-shaped notch 218 in the top end 146'. By rotating the closure 198 with respect to the bottle, the perpendicular surface 192' of the recess engages the cam follower 214 to flip the flexible spout to the open position as shown in FIG. 13. The recessed portion 190' is not sufficiently deep to allow the flexible spout to be pushed inwardly to the closed position. As in the embodiment illustrated in FIGS. 10 and 11, rotation of the closure aligns the dispensing apertures 180' and 154' to allow the contents of the bottle to be dispensed. Preferably, the wedge-shaped detent 194' and the detent on the closure 198 (not shown) are positioned to prevent the closure from being rotated back to the starting position such that the flexible spout cannot be aligned with the recess **198*b*** to provide an indicator that the closure has been opened.

While advantageous embodiments have been chosen to illustrate the invention, it will be understood by those skilled in the art that various changes and modifications can be made therein without departing from the scope of the invention as defined in the appended claims.

What is claimed is:

1. A closure for a bottle comprising in combination:

a cap member having a top end;

an outer annular exterior wall depending from said top end and extending toward an open bottom end of said cap opposite said top end;

an inner annular wall depending from said top end and extending toward said open bottom end concentric with said outer wall, said inner annular wall having a first dispensing outlet means;

a flexible spout integral with said cap, and being disposed to cooperate with said first dispensing outlet means, said flexible spout comprising first and second substantially triangular shaped panels coupled together along a first side edge of each panel by a common first hinge means, each panel having a second edge terminating at an apex with said first side, each said second edge being coupled to said cap by second hinge means, said spout being movable from an inwardly extending closed position to an outwardly extending open position;

detent means depending from said top end of said cap between said inner and outer walls and extending toward said open end, said detent means comprising a first leg fixed to said top end and a second leg removably coupled to said top end and aligned adjacent said first leg, said second removable leg being removable through said top end;

a generally cylindrical bottle neck attached to a bottle, said neck having an annular top edge dimensioned to fit in an annular space defined by said inner annular wall and outer annular wall of said cap, said inner wall being dimensioned to seal against an inner surface of said neck, said neck having a second dispensing outlet means cooperating with said first dispensing outlet means;

a recess in said annular top edge of said neck, said recess being dimensioned to complement said detent means when said cap is assembled on said neck to substantially prevent rotation of said cap on said neck;

said second removable leg of said detent means being removable from said top end of said cap to allow limited rotational movement of said cap on said bottle with said first fixed leg of said detent means being received in said recess of said top edge of said neck; and cam means on said upper annular edge of said neck operatively associated with said spout whereby rotation of said cap on said neck aligns said first and second dispensing outlet means and causes said cam means to cam said spout to said outward position.

2. A closure for a bottle comprising in combination:

a cap member having a top end;

an outer annular wall depending from said top end and extending toward an open bottom end of said cap opposite said top end;

an annular wall depending from said top end and extending toward said open bottom end concentric with said outer wall, said inner annular wall having a first dispensing outlet;

a flexible spout integral with said cap and being disposed to cooperate with said first dispensing outlet, said spout comprising first and second substantially triangular shaped panels coupled together along a first side edge of each panel by common first hinge means, each panel having a second edge terminating at an apex with said first edge, each said second edges being coupled to said cap by second hinge means, said spout being movable from an inwardly extending closed position to an outwardly extending open position;

a generally cylindrical bottle neck attached to a bottle, said neck dimensioned to fit in an annular space defined by said inner annular wall and outer annular wall of said cap, said inner wall being dimensioned to seal against an inner surface of said neck, said neck having a second dispensing outlet cooperating with said first dispensing outlet of said cap upon rotation of said cap relative to said neck; and cam means on an upper annular edge of said neck operatively associated with said spout whereby upon rotation of said cap on said neck from a closed position to an open position causes said cam means to cam said spout to said outward position and to align said first and second dispensing outlets.

3. The closure according to claim 2, wherein said first and second hinge means are living hinges integrally formed with said cap.

4. The closure according to claim 2, wherein said second edge of said first and second panels are hinged to said top end of said cap.

5. The closure according to claim 4, further comprising a second spout depending from said outer wall of said cap proximate said flexible spout.

6. The closure according to claim 2, wherein said second edge of each said first and second panels are hinged to said outer annular wall of said cap and movable from an inward closed position to an outward open position.

7. The closure according to claim 6, wherein said cam means is a first substantially V-shaped notch in said upper annular edge of said neck, said top end of said cap including a second V-shaped notch positioned to align with said first notch by rotation of said cap relative to said bottle to a closed position and said flexible spout being received in said first and second V-shaped notches when said cap is in said closed position.

8. The closure according to claim 2, further comprising cam follower means on an inner face of at least one of said first and second panels, said cam follower means being disposed to cooperate with said cam means.

9. The closure according to claim 2, wherein said cam means is a substantially V-shaped notch in an upper annular edge of said neck, said panels of said spout contacting edges of said V-shaped notch when said cap is in a closed position to form a substantially fluid tight seal.

10. The closure according to claim 2, further comprising detent means depending from said top end of said cap between said inner and outer walls and extending toward said open end, said detent comprising a first leg fixed to said top end and a second leg removably coupled to said top end adjacent said first leg, said bottle neck including a recess complementing said detent to prevent rotation of said cap with respect to said bottle neck.

11. The closure according to claim 2, wherein said bottle neck comprises an inner annular wall, said second dispensing outlet being disposed in said inner annular wall; and an outer annular wall concentric with said inner annular wall and said cam means being disposed on an upper edge of said outer wall.

12. The closure according to claim 2, further comprising first ratchet means coupled to an inner surface of said top end of said cap and second complementary ratchet means coupled to said upper annular edge of said neck to limit rotation of said cap.

13. A closure for a bottle comprising in combination:

a cap member having a top end;

an outer annular exterior wall depending from an outer edge of said top end and extending toward an open bottom end of said cap opposite said top end;

an inner annular wall depending from said top end and extending toward said open bottom end concentric to said outer wall, said inner wall having a first dispensing outlet;

a generally cylindrical bottle neck attached to a bottle, said neck having an annular top edge and an inner diameter complementing an outer face of said inner wall to form a seal, a second dispensing outlet in said neck positioned to allow alignment with said first dispensing outlet of said cap by rotation of said cap relative to said bottle neck;

a detent depending from said top end between said inner and outer annular walls and extending toward said open end, said detent comprising a first leg fixed to said top end and a second leg removably coupled to said top end adjacent said first leg, said second leg being removable from said top end through a top face of said cap;

a recess in said annular top edge of said neck, said recess being dimensioned to complement said detent when said cap is assembled on said neck to substantially prevent rotation of said cap on said neck;

said second removable leg of said detent being removable from said cap to allow limited rotational movement of said cap on said bottle with said first fixed leg of said detent being received in said recess.

14. The closure in accordance with claim 13, wherein said second removable leg of said detent is coupled to said cap by frangible means.

15. The closure in accordance with claim 14, wherein said frangible means is a weakened tear line.

16. The closure in accordance with claim 15, further comprising a pull strip attached to said second removable leg.

17. The closure in accordance with claim 13, further comprising a depending flange extending inwardly from a bottom end of said outer annular wall of said cap cooperating with an outwardly extending retaining flange on said neck to retain said cap on said bottle.

18. The closure in accordance with claim 13, and further comprising spout means on said cap aligned with said first dispensing outlet.

19. The closure in accordance with claim 13, wherein said first dispensing outlet is an aperture in said inner wall of said cap.

20. The closure in accordance with claim 13, wherein said first dispensing outlet is a notch in a bottom end of said inner wall of said cap and said second dispensing outlet is a notch in an upper edge of said bottle neck.

21. The closure in accordance with claim 13, further comprising a first air inlet means in said top end of said cap opposite said first dispensing outlet, and a second air inlet means in said bottle neck, said second air inlet means being disposed for aligning with said first air inlet means when in an open position.

22. The closure in accordance with claim 21, wherein said first air inlet means in said cap comprises an aperture in said top end and a notch in a bottom end of said inner wall, and said second air inlet means comprises a groove on an inner face of said neck for communicating with said aperture in said top end and said notch in said inner wall when said cap is rotated to an open position.

* * * * *